US005094207A

United States Patent [19]

Krampe et al.

[11] Patent Number: 5,094,207

[45] Date of Patent: Mar. 10, 1992

[54] METHOD AND APPARATUS FOR ADAPTING THE CHARACTERISTIC OF AN IDLING ADJUSTER

[75] Inventors: Wolfgang Krampe, Renningen; Helmut Janetzke, Schwieberdingen; Ernst Wild, Oberriexingen, all of Fed. Rep. of Germany

[73] Assignee: Robert Bosch GmbH, Stuttgart, Fed. Rep. of Germany

[21] Appl. No.: 555,395

[22] PCT Filed: Nov. 25, 1989

[86] PCT No.: PCT/DE89/00738

§ 371 Date: Sep. 24, 1990

§ 102(e) Date: Sep. 24, 1990

[87] PCT Pub. No.: WO90/07052

PCT Pub. Date: Jun. 28, 1990

[30] Foreign Application Priority Data

Dec. 14, 1988 [DE] Fed. Rep. of Germany ... P3842002.3

[51] Int. Cl.[5] ..... F02M 3/00

[52] U.S. Cl. ..... 123/339

[58] Field of Search ..... 123/339, 479, 399, 340, 123/350, 585

[56] References Cited

U.S. PATENT DOCUMENTS

| | | | |
|---|---|---|---|
| 4,274,381 | 6/1981 | Abo | 123/479 |
| 4,580,535 | 4/1986 | Danno et al. | 123/339 |
| 4,672,934 | 6/1987 | Peter et al. | 123/339 |
| 4,909,213 | 3/1990 | Mezger et al. | 123/339 |
| 4,993,383 | 2/1991 | Wokan et al. | 123/339 |

FOREIGN PATENT DOCUMENTS

| | | | |
|---|---|---|---|
| 2228594 | 8/1990 | United Kingdom | 123/339 |

*Primary Examiner*—Raymond A. Nelli
*Attorney, Agent, or Firm*—Walter Ottesen

[57] ABSTRACT

An apparatus 14 for adapting the characteristic of an idling adjuster has a release means 15 which allows adaptation only when the sign of a speed control deviation Δn corresponds to the sign of an air-quantity control deviation ΔQ.

This guarantees that the adaptation cannot counteract the speed control either as a result of still insufficient adaptation or by shunt signals from the air-quantity meter 11.

8 Claims, 2 Drawing Sheets

METHOD AND APPARATUS FOR ADAPTING THE CHARACTERISTIC OF AN IDLING ADJUSTER

FIELD OF THE INVENTION

The invention relates to a method and an apparatus for adapting the characteristic of an idling adjuster, such as is mounted in the intake section of an internal combustion engine, in order to adjust the charge during idling in such a way that a desired engine speed is maintained.

BACKGROUND OF THE INVENTION

A method and an apparatus to which the invention relates are described in U.S. Pat. No. 4,672,934. A provisional desired air quantity which is to result in a specific desired speed is determined as a function of values of various operating parameters, especially the engine temperature, gear position or switching state of an air-conditioning system. In order to guarantee that this desired speed is actually obtained, the control deviation between the desired speed and actual speed is used to form a value for a regulating air quantity which is added to the value of the provisional desired air quantity in order to obtain the actual desired air quantity. From this desired air quantity, a control value, especially a pulse-duty factor, is calculated for the idling adjuster by means of an air quantity control-value characteristic stored in a memory. When the characteristic is determined correctly, the idling adjuster is controlled by means of the read-out control value exactly in such a way that the actual intake air quantity precisely corresponds to the desired air quantity required. In contrast, if the characteristic is incorrect, for example because of a change in density of the air since the last determination of the characteristic or a change in the leakage-air fraction, an air quantity control deviation between the desired air quantity and actual air quantity is obtained. An adaptation of the mentioned characteristic is carried out by means of this air-quantity control deviation.

Accordingly, the known apparatus for adapting the characteristic curve of an idling adjuster has a speed subtraction means for forming the speed control deviation, an air-quantity subtraction means for forming the air-quantity control deviation, a characteristic memory and an adaptation means. Furthermore, a release means for releasing the adaptation is provided. The adaptation of the slope of the characteristic is released, for example, when a predetermined air-quantity throughput is exceeded. Offset adaptation takes place, for example, whenever the slope adaptation does not occur and a blocking time has elapsed.

When this apparatus and therefore the associated method are used, it has emerged that often less quiet running is obtained after a starting operation then without this apparatus and without this method.

On the one hand, it is the object of the invention to provide a method for adapting the characteristic curve of an idling adjuster by means of which smooth engine running can be achieved quickly, even after a starting phase. On the other hand, it is the object of the invention to provide an apparatus for carrying out such a method.

SUMMARY OF THE INVENTION

In the method according to the invention, the adaptation is carried out only when the speed control deviation has the same sign as the air-quantity control deviation. Accordingly, in the apparatus according to the invention, the release means is designed in such a way that it compares with one another the signs of parameters having the same signs as the speed control deviation and the air-quantity control deviation, and releases the adaptation only when the signs of the compared parameters correspond to one another.

The invention makes use of the following fact regarding operations in the starting phase of an engine and in the subsequent phase. In the starting phase, the air quantity and fuel quantity are controlled in such a way that the engine comes up to speed as quickly as possible. When a predetermined speed of, for example, 500 rpm is reached, there is a change-over from open-loop control to closed-loop idle control. After this change-over, the speed as a rule overshoots the predetermined idling speed, for example 700 rpm, and then falls below the desired speed. As soon as this happens, the speed control deviation acquires a positive sign which ensures that the desired air quantity is increased. However, shortly after the starting operation, the control winding of the idling adjuster is still colder than corresponds to the temperature at which the adjuster characteristic is conventionally recorded. The cold winding has a lower resistance than the warmer one, and therefore, when the pulse-duty factor is read out, a higher mean current flows than is actually desirable. The idling adjuster then allows an actual air quantity which is above the desired air quantity. This occurs continuously directly after the starting phase, so that, in the conventional method, an adaptation takes place with the effect of a reduction of the pulse-duty factor, that is the air quantity. This adaptation with the effect of a lower air quantity, performed continuously directly after the starting phase, counteracts the effort of the speed controller to increase the speed when this has fallen below the desired speed. However, if, according to the invention, the adaptation is prevented when the signs of the speed control deviation and air-quantity control deviation differ from one another, there is no possibility that the adaptation will counteract the control direction of the speed controller. This can therefore again increase the speed to the desired speed quickly.

A further advantage of the method according to the invention and of the apparatus according to the invention is that, when the voltage of the air-quantity meter is shunted, that is the actual air quantity is outputted incorrectly, there is no or only a very slow faulty adaptation. If, for example, there is a shunt to ground, a very small actual air quantity is measured continuously, the initial result of this being that an attempt is made via the adaptation to increase the air quantity. However, this immediately leads to a speed control deviation in the opposite direction, with the result that the adaptation is blocked. When the speed falls somewhat below the desired value again as a result of the speed control, the adaptation can once more take place briefly in the wrong direction. The speed controller counteracts this again. However, as soon as it reaches its set limit, it can no longer compensate the negative speed control deviation supplied to it, and therefore this negative control deviation continuously opposes the positive air-quantity control deviation. Adaptation is then blocked permanently. The same applies in reverse when there is a shunt of the air-quantity meter to the battery voltage.

With the known method and with the known apparatus, there was still a faulty adaptation even when the set range of the speed controller was reached in the two last-mentioned instances. The speed could therefore rise to the deceleration cutoff speed of, for example, 1,500 rpm or fall so far that the engine stopped.

It emerges from the foregoing that the critical factor in the adaptation release is the result of the sign comparison between the speed control deviation and air-quantity control deviation. However, it is not necessary for these control deviations to be compared with one another directly. This is because during the entire method flow there are parameters which certainly have the same sign as one of the control deviations mentioned. Thus, for example, the P section of a speed controller always has the same sign as the speed control deviation. The same applies to the differentiated I-component of such a controller. Furthermore, the sign of the differentiated adaptation values corresponds to the sign of the air-quantity control deviation. If the signs of such parameters having the same signs as the control deviations are compared with one another, the result of this corresponds to a direct comparison of the signs of the speed control deviation and air-quantity control deviation.

Moreover, it may be said that it is not at all necessary to determine the desired and actual values of the air quantity directly, in order to arrive at the sign of the air-quantity control deviation. In practice, there are known apparatus which work without an air-quantity meter and which instead calculate the air quantity by means of the speed and by means of a signal supplied by a throttle-flap angle sensor or a pressure sensor in the intake pipe. Such variables indicating the air quantity are designated in conjunction with this invention as air-quantity variables. Each control deviation of these air-quantity variables is based on a control deviation between the desired and actual values of the air quantity, that is the particular variable which is actually important.

If the air-quantity regulation is carried out by means of a pressure sensor, there is no need during the entire process flow to actually calculate the air quantity. By means of the speed and the speed control deviation, a desired intake pressure can be calculated on the basis of known relations. This pressure serves as an air-quantity variable for addressing the air-quantity control-value characteristic of the idling adjuster. The adaptation is carried out on the basis of a comparison between the desired intake pressure and the actual intake pressure measured by the pressure sensor. In this case, the sign of the air-quantity control deviation is detected by means of the sign of the intake-pressure control deviation.

The idling adjuster can be any apparatus suitable for this purpose, that is especially a bypass valve or a throttle-flap idling stop.

BRIEF DESCRIPTION OF THE DRAWING

The invention will now be described with reference to the drawing wherein.

DESCRIPTION OF THE PREFERRED EMBODIMENTS OF THE INVENTION

Figure 1:
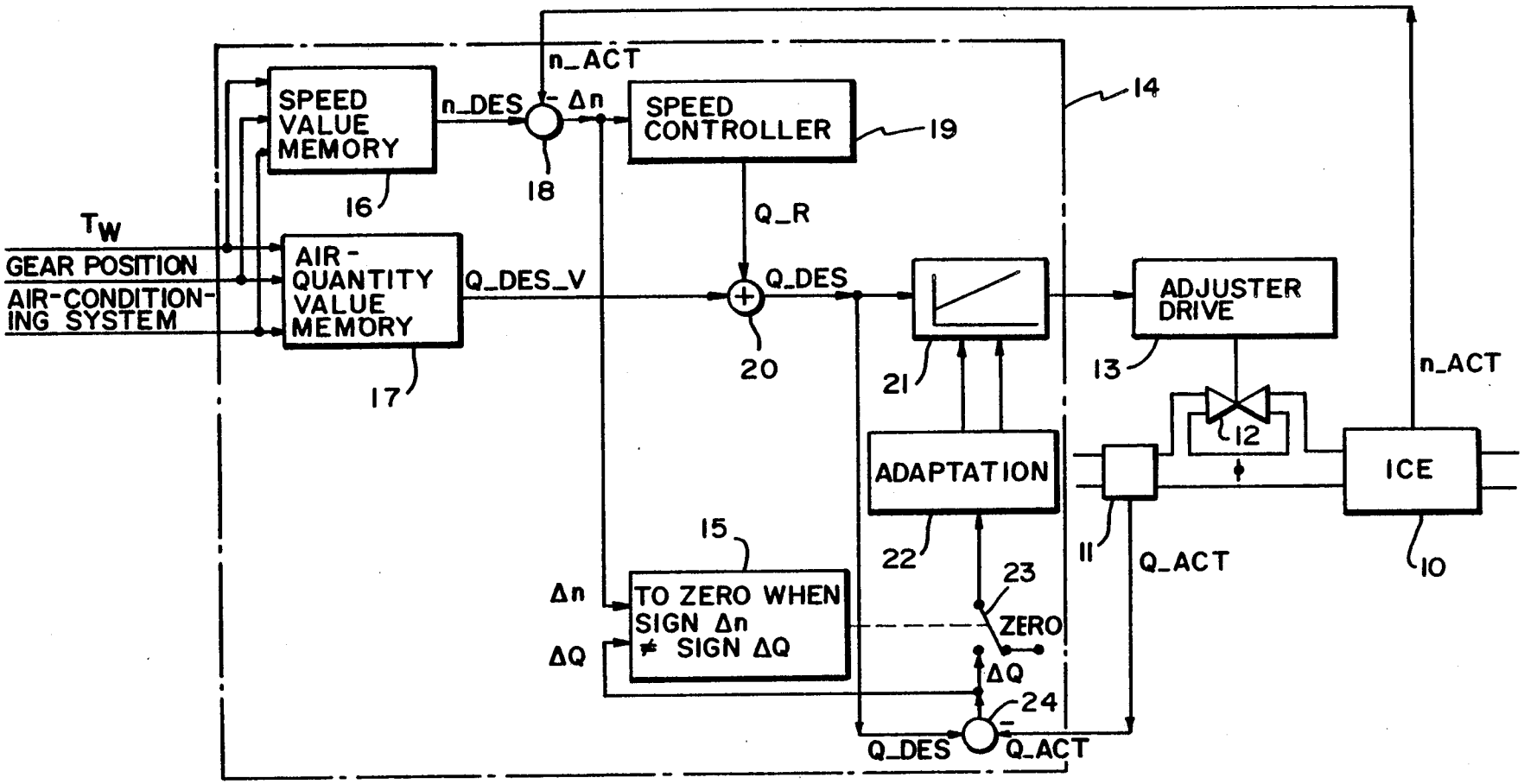
FIG. 1 shows an internal combustion engine with an idling adjuster and a block diagram of an apparatus for adapting the characteristic of the idling adjuster; and, FIG. 2 shows a flowchart illustrating the method of the invention.

The figure shows an internal combustion engine 10 with an air-quantity sensor 11, an idling adjuster 12 and an adjuster drive 13 as well as the block diagram of an apparatus 14 for adapting the characteristic of the idling adjuster 12.

The apparatus 14 contains various functional groups. Of particular importance is a release or enabling means 15 which allows adaptation when the signs of a speed control deviation and of an air-quantity control deviation correspond to one another. The apparatus 14 illustrated differs from a known apparatus, such as is described in detail in U.S. Pat. No. 4,672,934, in this function of the release means 15. All the other functional groups are therefore dealt with only briefly. Attention is drawn to U.S. Pat. No. 4,672,934 for detailed information.

In addition to the release means 15, the apparatus 14 contains a speed-value memory 16, an air-quantity value memory 17, a speed subtraction means 18, a speed controller 19, an addition means 20, a characteristic memory 21, an adaptation means 22 and a release switch 23.

The speed-value memory 16 and the air-quantity value memory 17 are addressed with values of operating parameters. In the particular example, these are values of the engine temperature $T_w$ (coolant temperature), the gear position and the switching state of an air-conditioning system. Each air-quantity value read out from the air-quantity value memory 17 as a function of values of the operating parameters sets a provisional air-quantity desired value Q_DES_V, to which an air-quantity value Q_R from the speed controller 19 is added in the addition means 20. This value is calculated by the controller 19 as a function of the speed control deviation $\Delta n$ which is calculated by the speed subtraction means 18 by subtracting the actual speed from the desired speed, such as is read out from the speed-value memory 16 as a function of the values of the operating parameters. The desired air quantity Q_DES formed in the addition means 20 is supplied to the characteristic memory 21. The pulse-duty factor belonging to the entered desired air quantity is read out as a control value for the adjuster drive 13 from the stored characteristic.

The characteristic stored in the characteristic memory 21 is adapted by means of the air-quantity control deviation $\Delta Q$, such as is formed by an air-quantity subtraction means 24 by subtracting the actual air quantity measured by the air-quantity meter 11 from the desired air quantity. By means of this air-quantity control deviation, the adaptation means 22 calculates adaptation values for the offset and slope of the characteristic.

The respective current values of the speed control deviation $\Delta n$ and air-quantity control deviation $\Delta Q$ are supplied to the release means 15. As long as the signs of these two control deviations correspond to one another, the release means controls the release switch 23 in such a way that the latter connects the output of the air-quantity subtraction means 24 to the input of the adaptation means 22. In contrast, if the condition is not satisfied, the input of the adaptation means 22 is applied by means of the release switch 23 to a signal of zero value. No adaptation therefore takes place.

It is pointed out that, in practice, the functional blocks 16 to 24 of the apparatus 14 for adapting the characteristic of the idling adjuster 12 are preferably obtained by an appropriate programming of a microcomputer.

Figure 2:
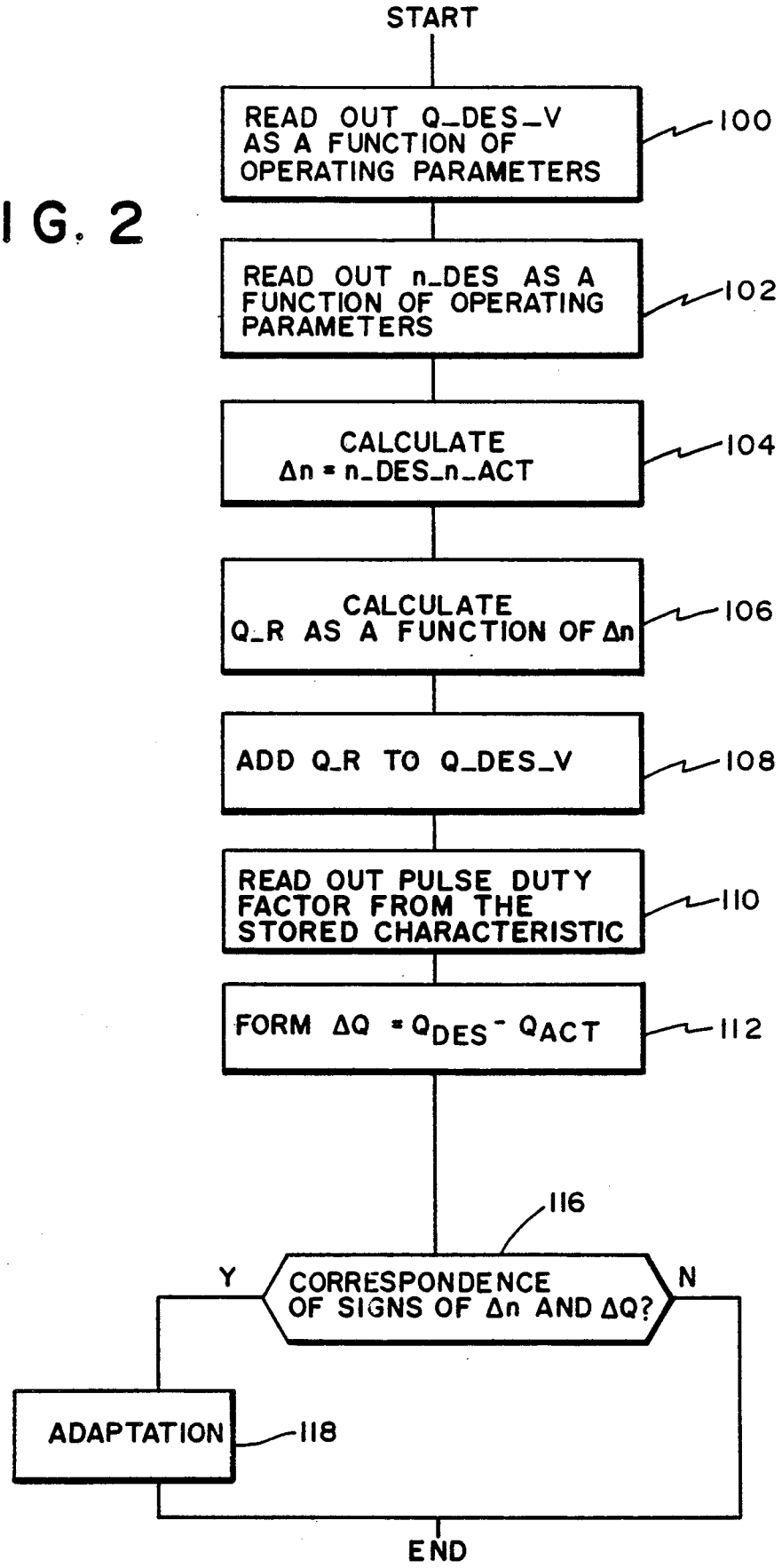

The flowchart of FIG. 2 illustrates the method of the invention and will now be briefly described.

After the start of the program part, a preliminary air quantity value Q_DES_V is read of the air-quantity value memory 17 in a first step 100 in dependence upon operating parameters such as engine temperature, gear position and switching state of an air conditioner. In step 102, a desired engine-speed value n_DES is read out of the speed-value memory 16 in dependence upon the operating parameters. Thereafter, in step 104, the speed control deviation Δn is computed as the difference between the desired speed n_DES and the actual speed n_ACT and an air-quantity value QR is formed in step 106 by the speed controller 19. This takes place via control equations dependent upon the speed difference Δn from step 104. The air-quantity value QR is added to the preliminary air-quantity desired value Q_DES_V in step 108. The addition result is then the desired air- via the stored characteristic (characteristic memory 21) into a drive value (pulse-duty factor) for the actuating drive for adjusting the desired air quantity. Thereafter, in step 112, the air-quantity control deviation ΔQ is formed in the air-quantity subtraction means 14 by subtracting the actual air quantity Q_ACT measured by the air-quantity sensor 11 from the desired air quantity determined in step 108. Thereafter, in inquiry step 114, a check is made as to whether the sign of the speed-control deviation and the air-quantity control deviation are the same. If the signs are not the same, the program is ended. However, if both control deviations have the same sign, then the stored characteristic is adapted by adapting its offset and/or slope in dependence upon the air-quantity control deviation in a manner shown in U.S. Pat. No. 4,672,934 referred to herein. Thereafter the program part is ended.

In the exemplary embodiment, it was assumed that the position of the idling adjuster 12 is adjusted by changing the pulse-duty factor of the voltage controlling it. However, the control value can be any other value which is suitable for determining the air quantity to be allowed through by an idling adjuster It is also pointed out that it can be suitable to process still further parameters in the apparatus 14, for example the battery voltage, if the idling adjuster 12 is not supplied with a constant voltage, which is usually not the case. If the control voltage falls, the pulse-duty factor must be increased correspondingly, in order to obtain the same respective throughflow quantity through the idling adjuster for the same desired air quantity.

We claim:

1. In an internal combustion engine equipped with an idling adjuster having an air-quantity value characteristic and an adapter for adapting the offset and slope of said characteristic, the method comprising the steps of:

measuring the actual speed of the engine;

forming a speed control deviation Δn between a desired speed and the actual speed of the engine;

determining a desired value of an air-quantity variable from this speed control deviation Δn in order to set a desired air quantity which is suitable for cancelling the speed control deviation Δn;

measuring the actual value of the air supplied to the engine to provide an air-quantity variable indicative of the air supplied to the engine;

forming the air-quantity variable control deviation ΔQ between the desired and actual values of the air-quantity variable with the control deviation ΔQ being based on an air-quantity control deviation;

supplying said air-quantity variable control deviation ΔQ to said adapter;

monitoring said speed control deviation Δn and said air-quantity variable control deviation ΔQ to initiate an enabling function when said control deviations Δn and ΔQ have the same sign; and, adapting the air-quantity control-value characteristic of the idling adjuster in said adapter by utilizing said air-quantity variable control deviation ΔQ in response to said enabling function.

2. The method of claim 1, wherein the sign of the speed control deviation Δn is used directly for the sign comparison.

3. The method of claim 1, wherein a parameter always having the same sign as the speed control deviation Δn is used for the sign comparison.

4. The method of claim 1, wherein the air-quantity control deviation is formed as the air-quantity variable control deviation ΔQ and the sign of the air-quantity control deviation is used directly for the sign comparison.

5. The method of claim 1, wherein a parameter always having the same sign as the air-quantity control deviation is used for the sign comparison.

6. The method of claim 1, wherein the actual air quantity is measured and the air quantity itself is used as the air-quantity variable.

7. The method of claim 1, comprising the further steps of: measuring the actual intake pressure and determining the desired intake pressure from the speed and speed deviation to thereby use the intake pressure as the air-quantity variable.

8. Apparatus for adapting the characteristic of an idling adjuster for an internal combustion engine, the idling adjuster having an air-quantity control-value characteristic and the apparatus comprising:

means for measuring the actual speed of the engine;

speed subtraction means for forming the speed control deviation Δn between the desired and actual speeds of the engine;

means for measuring the actual value of the air supplied to the engine to provide an air-quantity variable indicative of the air supplied to the engine;

air-quantity variable subtraction means for forming an air-quantity variable control deviation ΔQ between a desired and said actual value of an air-quantity variable;

a characteristic memory for storing said air-quantity variable control-value characteristic;

monitoring and enabling means for monitoring said speed control deviation Δn and said air-quantity variable control deviation ΔQ and for initiating an enabling function when said control deviations Δn and ΔQ have the same sign;

adaptation means for adapting said characteristic in the characteristic memory in response to said enabling function.

* * * * *

UNITED STATES PATENT AND TRADEMARK OFFICE

CERTIFICATE OF CORRECTION

PATENT NO. : 5,094,207

DATED : March 10, 1992

INVENTOR(S) : Wolfgang Krampe, Helmut Janetzke and Ernst Wild

It is certified that error appears in the above-identified patent and that said Letters Patent is hereby corrected as shown below:

In column 5, line 21: after "air-", insert -- quantity value Q_DES which, in step 110, is converted --.

In column 5, line 44: after "adjuster", insert -- . --.

Signed and Sealed this

Eighth Day of June, 1993

*Attest:*

Michael K. Kirk

MICHAEL K. KIRK

*Attesting Officer*

*Acting Commissioner of Patents and Trademarks*